US006759930B2

(12) United States Patent
Kayano et al.

(10) Patent No.: US 6,759,930 B2
(45) **Date of Patent: *Jul. 6, 2004**

(54) FILTER CIRCUIT AND A SUPERCONDUCTING FILTER CIRCUIT

(75) Inventors: Hiroyuki Kayano, Kanagawa-ken (JP); Fumihiko Aiga, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/210,084

(22) Filed: Aug. 2, 2002

(65) Prior Publication Data

US 2002/0186092 A1 Dec. 12, 2002

Related U.S. Application Data

(62) Division of application No. 09/810,479, filed on Mar. 19, 2001, now Pat. No. 6,518,854.

(30) Foreign Application Priority Data

Mar. 30, 2000 (JP) ..... 2000-095531
Jan. 29, 2001 (JP) ..... 2001-019479

(51) Int. Cl.[7] ..... H01P 1/903
(52) U.S. Cl. ..... 333/995; 333/204; 505/700
(58) Field of Search ..... 333/995, 704, 333/165, 167, 172, 175, 177; 505/210, 700, 701, 866

(56) References Cited

U.S. PATENT DOCUMENTS 2,716,733 A 8/1955 Roark
5,184,096 A * 2/1993 Wakino et al. ..... 333/175

FOREIGN PATENT DOCUMENTS

| | | |
|---|---|---|
| DE | 196 20 932 | 8/1997 |
| EP | 0 396 123 | 11/1990 |
| GB | 1062269 | 3/1997 |
| WO | WO 95/28746 | 10/1995 |

OTHER PUBLICATIONS

Takayuki Kato, et al. "Studies on the equivalent circuits of dual–mode rectangular waveguide filters using HFSS and MDS", Technical Report of IEICE, MW 98–85, Sep. 1998, pp. 73–80.

Kenji Yamanaka, et al. "Studies on dual–and triple–mode rectangular waveguide filters using HFSS and MDS", Technical Report of IEICE, MW 98–114, Nov. 1998, pp. 21–26.

* cited by examiner

*Primary Examiner*—Anh Q. Tran
(74) *Attorney, Agent, or Firm*—Oblon, Spivak, McClelland, Maier & Neustadt, P.C.

(57) ABSTRACT

A filter circuit includes a first resonator and a second resonator each having a different resonance frequency. The first resonator is included in a first block, and the second resonator is included in a second block. The first block further includes a first delay unit connected to the first resonator. An input terminal divides an input signal to the first block and the second block. An output terminal combines signals passing through the first block and the second block and outputs the combined signal. The first delay unit converts a phase difference between the signals passing through the first block and the second block to reverse-phase or nearly reverse-phase.

20 Claims, 21 Drawing Sheets

FILTER CIRCUIT AND A SUPERCONDUCTING FILTER CIRCUIT

This application is a Division of application Ser. No. 09/810,479 Filed on Mar. 19, 2001 now U.S. Pat. No. 6,518,854.

FIELD OF THE INVENTION

The present invention relates to a filter circuit and a superconducting filter circuit each for limiting bandwidth of a transmitter such as a portable wireless terminal or a base station using wireless communication.

BACKGROUND OF THE INVENTION

As shown in FIG. 1, a filter circuit for bandwidth limit has cascaded resonators 153*a*, 153*b*, and 153*c* cascaded. In FIG. 1, an equivalent circuit of each resonator includes an inductor and a capacitor. If lose effect is also taken into consideration, then resistance is added.

Assuming non-resistance, the resonance frequency f0 of the resonator is represented as follows.

$$f0=1/\{2\pi\sqrt{(L\cdot C)}\}$$

(L: inductance of the resonator, C: capacitance of the resonator)

In the filter circuit, a plurality of resonators are cascaded. Accordingly, by adequately setting the coupling factor between resonators "M2, M3," representing a coupling factor of each resonator and external Q (coupling factor between resonators "M1, M4") representing a value to excite the resonator by input/output unit, designable frequency band and attenuation of stop-band for the filter circuit are determined.

As one example of the filter circuit, FIG. 2 shows a component example using microstrip lines. In FIG. 2, microstrip conductors 161, 162, 163*a*, 163*b*, and 163*c* are formed on the surface of a dielectric substrate 164. On the reverse side of the dielectric substrate 164, a ground metal (not shown in FIG. 2) is set. The microstrip conductor, the dielectric substrate, and the ground metal compose the microstrip line. In order to compose three resonators, the microstrip conductors 161 and 162 are formed on a main face of the dielectric substrate. Three microstrip conductors 163*a*, 163*b*, 163*c* having length equal to the half-wave length of the designable frequency band are formed between excitation lines 161, 162 of the input/output side by shifting every ¼ wave length. For example, the component element of the resonator is the microstrip conductor 163*a* and a circumferential dielectric (the dielectric substrate 164 and an exposure part (air)). The space between the resonators determines the value of the coupling factor between the resonators. The excitation lines 161, 162 of input/output side are located at a distance representing a desirable external Q from the resonator.

In many filter circuits, all resonators are cascaded. As a result, electric power passing through the filter circuit passes each resonator by the same electric power. However, the resonator includes loss effect, and pass-electric power is slightly different because of the lose effect. The filter circuit through which large electric power passes is heated by the loss effect, and it is important that the filter circuit includes a radiating thermal component. In case that a distributed element circuit such as the microstrip line is used as the filter circuit, the circuit component becomes small. However, in this case, the loss becomes large and the radiating thermal characteristic falls.

Accordingly, in order to realize a low lose and a small circuit size, the microstrip line filter circuit in which a superconducting conductor is used as the microstrip conductor is utilized. In this case, lines of electric force are generated in this microstrip line. As shown in FIG. 3, the lines of electric force 174 generates in the dielectric 173 between the microstrip conductor 171 and the ground metal 172, and an electric field concentrates on a sectional edge of the line (the microstrip conductor 171) through which signal electric power passes. In short, electric current concentrates on this edge part. Accordingly, in case of passing a large electric power, the electric current flowing through the edge exceeds the threshold of critical current density in spite of several-watt electric power, and it breaks the superconducting characteristic.

As mentioned-above, in known filter circuits, a plurality of resonators are cascaded in order to vary the designable frequency band. However, when the large electric power passes through the filter circuit of cascade connection, the large electric power equally passes through all resonators in the filter circuit. Accordingly, large characteristic of maximum available power is necessary for this filter circuit.

Furthermore, in the filter circuit using the microstrip line resonator, in case of passing the large electric power, the electric current concentrates on the edge of the microstrip conductor. Accordingly, in case of using the superconducting conductor, the electric current exceeds the critical current density and breaks the superconducting characteristic.

SUMMARY OF THE INVENTION

It is an object of the present invention to provide a filter circuit and a superconducting filter circuit of small size having superior characteristic of maximum available power.

According to the present invention, there is provided a filter circuit, comprising: a first resonator and a second resonator each having a different resonance frequency, a first block including the first resonator and a second block including the second resonator, wherein the first block includes a first delay unit connected to the first resonator; an input terminal configured to divide an input signal to the first block and the second block; and an output terminal configured to combine signals passing through the first block and the second block, and to output the combined signal; wherein said first delay unit converts a phase difference between the signals passing through the first block and the second block to reverse-phase or nearly reverse-phase.

Further in accordance with the present invention, there is also provided a superconducting filter circuit, comprising: a first resonator and a second resonator each having a different resonance frequency, a first block including the first resonator having a superconcuctive material and a second block including the second resonator having a superconductive material, wherein the first block includes a delay unit connected to the first resonator; an input terminal configured to divide an input signal to the first block and the second block; and an output terminal configured to combine signals passing through the first block and the second block, and to output the combined signal; wherein said delay unit converts a phase difference between the signals passing through the first block and the second block to reverse-phase or nearly reverse-phase.

Further in accordance with the present invention, there is also provided a filter circuit, comprising: a first resonator and a second resonator each having a variable resonance frequency, a first block including the first resonator and a second block including the second resonator, wherein the first block includes a delay unit connected to the first resonator; an input terminal configured to divide an input signal to the first block and the second block; and an output terminal configured to combine signals passing through the first block and the second block, and to output the combined signal; wherein the resonance frequency of at least one of the first resonator and the second resonator is varied by an external control signal.

Further in accordance with the present invention, there is also provided a superconducting filter circuit, comprising: a first resonator and a second resonator each having a variable resonance frequency, a first block including the first resonator and a second block including the second resonator, wherein the first block includes a delay unit connected to the first resonator; an input terminal configured to divide an input signal to the first block and the second block; and an output terminal configured to combine signals passing through the first block and the second block, and to output the combined signal; wherein the resonance frequency of at least one of the first resonator and the second resonator is varied by control signal from external.

DETAILED DESCRIPTION OF THE EMBODIMENTS

Figure 4:
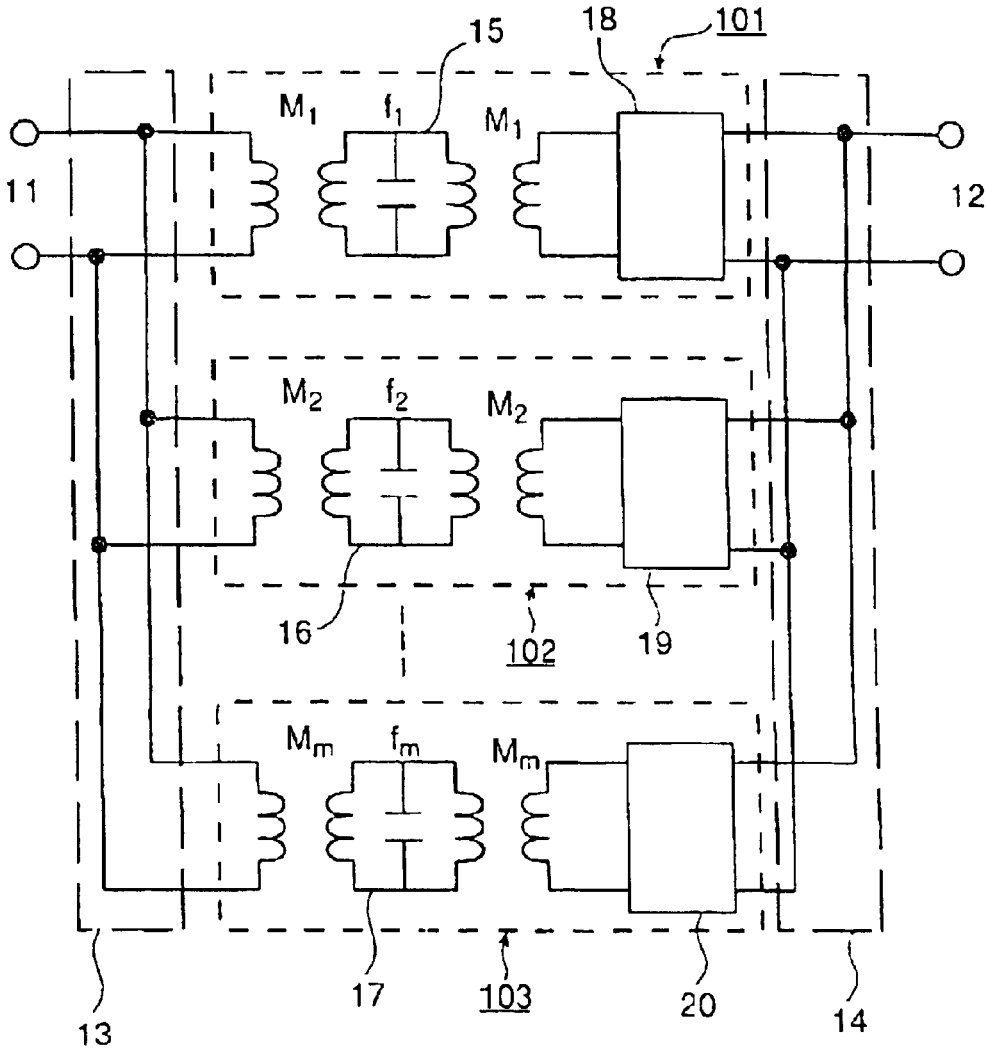
FIG. 4 is a block diagram of a filter circuit according to a first embodiment of the present invention.

Hereinafter, embodiments of the present invention are explained below with reference to the drawings. FIG. 4 is a block diagram of a filter circuit according to a first embodiment of the present invention. A resonator 15 having a resonance frequency f1 and a cascade connected delay unit 18 form a first block 101. In the same way, a resonator 16 having a resonance frequency f2 and a cascade connected delay unit 19 form a second block 102. A resonator 17 having a resonance frequency fm and a cascade connected delay unit 20 form a third block 103.

In FIG. 4, the filter circuit includes an input terminal 11, an output terminal 12, an electric power division unit 13 as parallel-connection part of the input terminal 11, an electric power combination unit 14 as parallel-connection part of the output terminal 12, and the first, second, and third blocks 101~103 each connected in parallel between the electric power division unit 13 and the electric power combination unit 14. The electric power division unit 13 divides an input signal from the input terminal to the first, second, and third blocks 101~103. The electric power combination unit 14 combines signals passed through the first, second, and third blocks 101~103 and outputs a combined signal to the output terminal 12. Although FIG. 4 shows three resonators 15, 16, and 17, the first embodiment is not limited to this number. In case of creating a desirable pass-band filter, if the number of resonance frequencies in this pass-band is m, then the number of resonators is m ($m \geqq 2$: integer) and the number of delay units is also m.

The resonators 15, 16, 17 have respectively different resonance frequencies f1, f2, . . . , fm. Each resonance frequency f1, f2, . . . , fm may be either equal interval or unequal interval. Assume that each resonance frequency f1, f2, . . . , fm satisfies a relation "f1<f2< . . . <fm". First, a design example of the relation "f1<f2< . . . <fm" is explained. The resonance frequency f0 is determined by inductance L and capacitance C of the resonator using the following equation (1). In this case, resistance does not exist in the resonator.

$$f0=1/\{2\pi\sqrt{(L\cdot C)}\} \quad (1)$$

Accordingly, by suitably setting at least one of the inductance L and the capacitance C of each resonator, the relation "f1<f2< . . . <fm" is satisfied. The delay units 18, 19, 20 convert a phase difference between two adjacent resonance frequencies (very two closest resonance frequencies on frequency axis) of every two blocks (101 and 102, 102 and 103) as nearly reverse-phase. The nearly reverse-phase means nearly 180° an follows.

(1) A phase of the second block 102 is delayed from a phase of the first block 101 as nearly 180°, and a phase of the third block 103 is delayed from the phase of the second block 102 as nearly 180°.

(2) The phases of the first block 101 and the third block 103 are respectively delayed from the phase of the second block 102 as nearly 180°.

In this case, the phase difference between two adjacent frequencies of every two blocks may be different by 360°×n (n≧0: integer) if the phase difference satisfies the relation of reverse-phase. Furthermore, nearly 180° represents a limit of 180°±30°, and the phase difference is regarded as reverse-phase if it is within this limit. Accordingly, in general, the phase difference X between two adjacent frequencies of two blocks is represented by the following equation (2).

$$150°+360°\times n \leqq X \leqq 210°+360°\times n \ (n \geqq 0\text{: integer}) \quad (2)$$

A mutual coupling degree Mi (i=1~m) of each resonator is equal-phase coupling. In the first embodiment, reverse-phase coupling is not included, and the coupling is realized in the distributed element circuit and the lumped element circuit except for the microwave circuit. In FIG. 4, coupling factors of the input side and the output side of each resonator are the same. However, even if the coupling factors of the input side and the output side are different, the first embodiment is applied.

Figure 5:
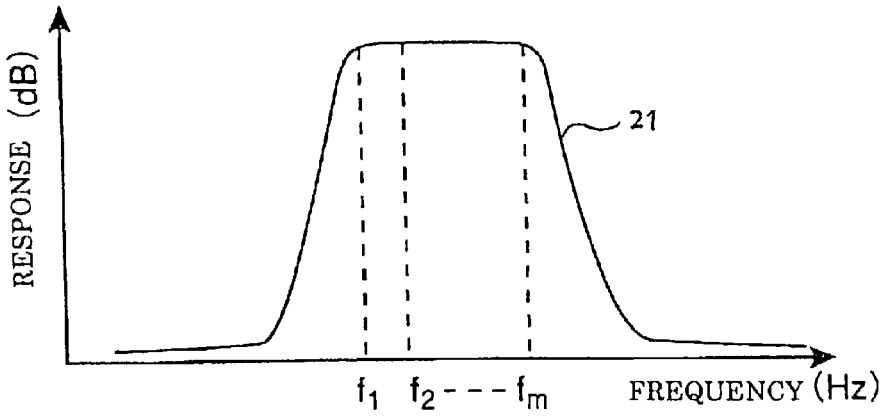
FIG. 5 is a waveform diagram of frequency response from input terminal 11 to output terminal 12 in FIG. 4.

FIG. 5 is a waveform diagram of frequency response from the input terminal 11 to the output terminal 12 in the filter circuit shown in FIG. 4. The waveform 21 includes pass-characteristic within resonance frequency band f1~fm of the resonators. In FIG. 4, pass-range and attenuation of out-band in curved line 21 of frequency response are realized by suitably selecting the mutual coupling degree Mi of each resonator 15, 16, and 17.

Figure 6:
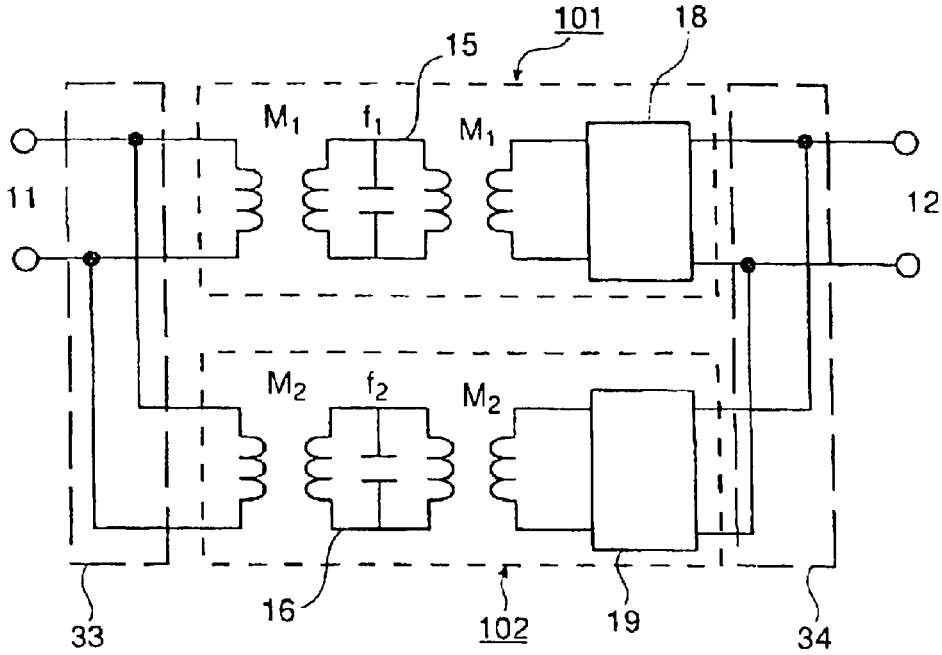
FIG. 6 is a block diagram explaining the operation of the filter circuit shown in FIG. 4.
Figure 7:
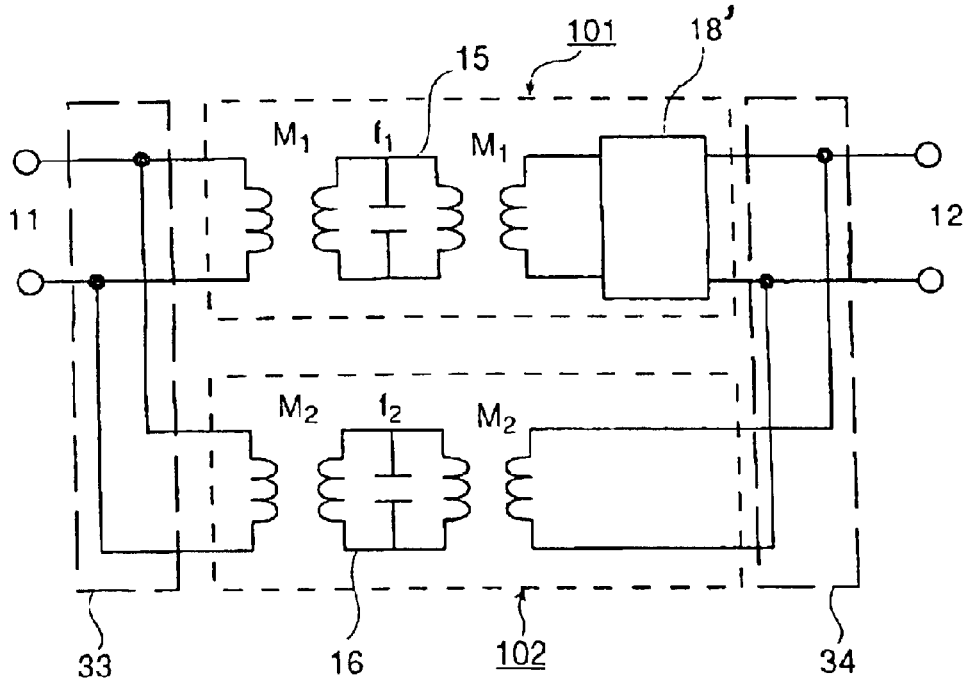
FIG. 7 is another block diagram explaining the operation of the filter circuit shown in FIG. 4.

FIGS. 6 and 7 are block diagrams to explain the operation of the filter circuit shown in FIG. 4. In this case, two resonators 15, 16 each connected in parallel to the electric power division unit 33 and the electric power combination unit 34 are explained. In FIG. 6, as for the delay unit 18 cascaded to the resonator 15 having the resonance frequency f1 and the delay unit 19 cascaded to the resonator 16 having the resonance frequency f2, the phase difference of the equation (2) is realized. Thus, the resonance frequency f1 of the first block 101 including the resonator 15 and the delay unit 18 and the resonance frequency f2 of the second block 102 including the resonator 16 and the delay unit 19 are mutually related as nearly reverse-phase. As shown in FIG. 7, even if the second block 102 does not include the delay unit 19, if a phase difference between a signal and a pre-passing signal passed through the delay unit 18' of the first block 101 represents a relation of the equation (2), the first block 101 and the second block 102 have a phase difference of the equation (2).

Figure 8:
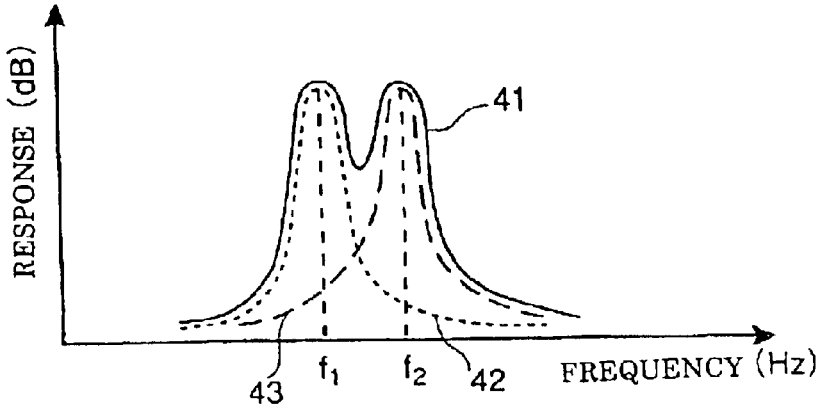
FIG. 8 is a waveform diagram of frequency response in case of reverse-phase in FIG. 6.

FIG. 8 is a waveform diagram of frequency response in case of reverse-phase in FIG. 6. If the phase difference between two resonators 18, 19 satisfies a condition of the equation (2), characteristic curved line 41 of the filter circuit is calculated as a sum of characteristic curved line 42 of frequency response of the resonator 15 and characteristic curved line 43 of frequency response of the resonator 16. Ripple of the characteristic curved line 41 between f1 and f2 is controlled as ripple value in desirable filter waveform by suitably setting the frequency interval between f1 and f2 and the mutual coupling degrees M1 and M2 between the resonators 15 and 16. For example, if the ripple value is set below 3 dB, the frequency response includes a pass-characteristic between response frequency band f1~f2. In order to set the ripple value below 3 dB, the phase difference between the first block 101 and the second block 102 is set within the limit (−30°~+30°) from reverse-phase (180°) as shown in equation (2).

Figure 9:
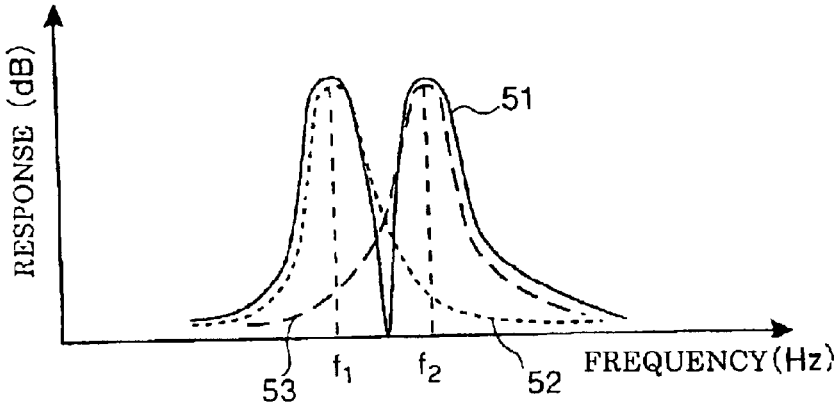
FIG. 9 is a waveform diagram of frequency response in case of equal-phase in FIG. 6.

Furthermore, if the delay unit 18 cascaded to the resonator 15 having the resonance frequency f1 and the delay unit 19 cascaded to the resonator 16 having the resonance frequency f2 are related as the phase difference of "(360°×n)±30° (n≧0: integer)", the resonance frequencies of the first block 101 and the second block 102 are regarded as nearly equal-phase. FIG. 9 is a waveform diagram of frequency response in case of equal-phase in FIG. 6. As shown in FIG. 9, if the phase difference between two delay units 18, 19 satisfies the limit. "(360°×n)±30° (n≧0: integer)", the characteristic curved line 51 of the filter circuit is calculated as a difference between the characteristic curved line 52 of the frequency response of the resonator 15 and the characteristic curved line 53 of the frequency response of the resonator 16. The control of ripple value by mutual coupling degree has a limit. Accordingly, in case of nearly equal-phase, the characteristic curved line 51 does not include the pass-characteristic in the resonance frequency band f1~f2.

By designing the circuit component shown in FIGS. 4 and 6, the pass-electric power is divided to each resonator. Accordingly, in comparison with the past cascade connected resonators, the characteristic of maximum available power is superior. This feature also improves a filter circuit of microstrip line type using superconductors. By using small-sized filters of microstrip line type, the filter circuit having maximum available power above several-watt is realized.

Figure 10:
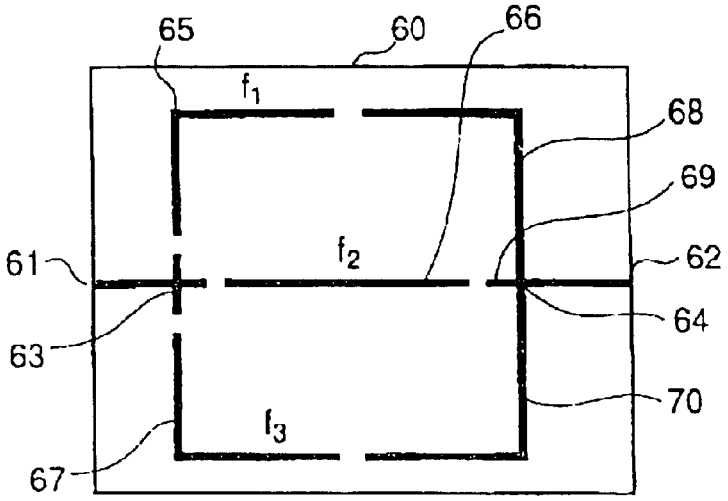
FIG. 10 is an example of the filter circuit shown in FIG. 4.
Figure 11:
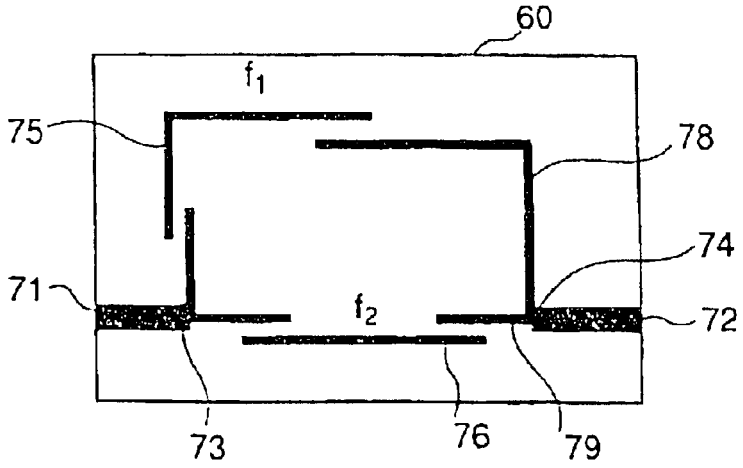
FIG. 11 is another example of the filter circuit shown in FIG. 4.

Component examples of a filter circuit of the microstrip line type of the first embodiment are shown in FIGS. 10 and 11. FIG. 10 shows the filter circuit of end-couple type and FIG. 11 shows the filter circuit of side-couple type. In FIG. 10, an input terminal 61, an output terminal 62, an electric power division means 63, and an electric power combination means 64 are formed on a main face of a dielectric substrate 60. On the other side of the dielectric substrate 60 (relative dielectric constant εr=24), a ground metal is formed (not shown in FIG. 10). The resonator in FIG. 4 corresponds to microstrip conductors 65, 66, 67 of half-wave length of the designable frequency and circumferential dielectric (the dielectric substrate 60 and exposed part (air)). The delay unit in FIG. 4 corresponds to microstrip conductors 68, 69, 70 each including half-wave length between adjacent lines (68 and 69, 69 and 70). By this component, the resonator 66 having the resonance frequency f2 includes the phase difference "180°" for the resonator 65 having the resonance frequency f1 and the resonator 67 having the resonance frequency f3. Furthermore, the electric power from the input terminal 61 is supplied to each resonator 65, 66, 67 by the electric power division means 63. The divided electric power through three resonators 65, 66, 67 is combined by the electric power combination means 64 and is connected to the output terminal 62. In this case, the electric power combination means 64 is represented as a joint point of microstrip conductors 68, 69, 70. In the example of FIG. 10 not equivalent circuit diagram as FIG. 4, the electric power combination means 64 and the output terminal 62 are regarded as the identical one. In the same way, the electric power division means 63 and the input terminal 61 are regarded as the identical one.

In FIG. 10, in case that the designable frequency band is 2 GHz, the width of all microstrip conductor is 0.2 mm, the length of microstrip conductor 65 is 20.02 mm, the length of microstrip conductor 66 is 20.10 mm, the length of microstrip conductor 67 is 20.18 mm, the length of microstrip conductor 68 is 20 mm, and the length of microstrip conductor 70 is 20 mm. Furthermore, as material of the microstrip conductor one or more of Cu, Ag, Au, superconductor (YBCO), are preferably utilized. As material of the dielectric substrate one or more of sapphire, alumina, $LaAlO_3$, MgO, $SrTiO_3$, are preferably utilized.

In case that impedance matching is set at a branch point of the electric power division means and the electric power combination means, the width of the microstrip conductor is varied as shown in FIG. 11. In this case, while the width of the microstrip conductor of the resonator and the delay unit is 0.2 mm in the same way as in FIG. 10, the width of microstrip conductor of the input terminal 71 and the output terminal 72 is 0.8 mm. The length of microstrip conductor 75 is 20.02 mm, the length of microstrip conductor 76 is 20.10 mm, and the length of microstrip conductor 78 is 20 mm.

In FIG. 11, the resonators 75, 76 of half-wave length are utilized as the resonator, and transmission lines 78, 79 including half-wave length between adjacent lines are utilized as the delay unit. By using these components, the resonator 76 having the resonance frequency f2 is realized as the phase difference 180° for the resonator 75 having the resonance frequency f1. The electric power from the input terminal 71 is supplied to each resonator 75, 76 by the electric power division means 73. The divided electric power through two resonators 75, 76 in combined by the electric power combination means 74 and output from the output terminal 72.

Figure 12:
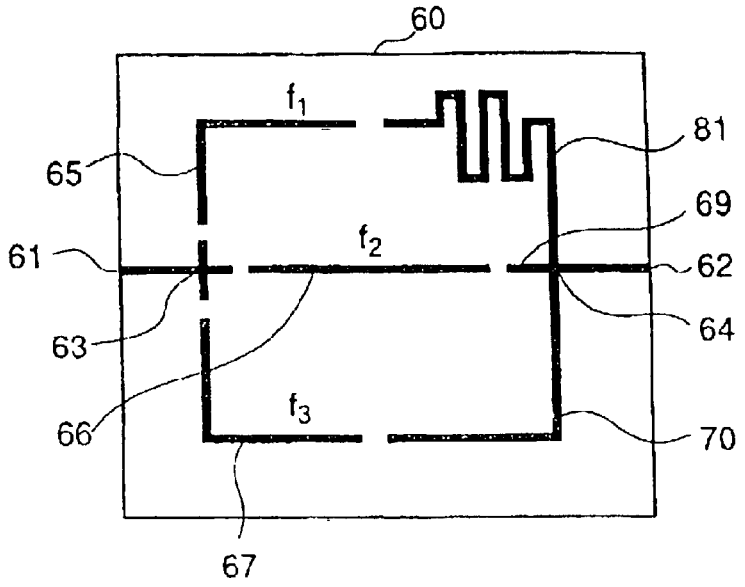
FIG. 12 is a modification example of the filter circuit shown in FIG. 10.

FIG. 12 shows a modification example of FIG. 10. Instead of the delay unit 68 in FIG. 10, a meandering line is used as the delay unit 81. By using this meandering line, a large delay value can be realized. Furthermore, if order of height of resonance frequency of each resonator 65, 66, 67 including a microstrip conductor satisfies the delay difference condition of equation (2), the resonance frequency of each resonator may be assigned in an arbitrary order.

Figure 13:
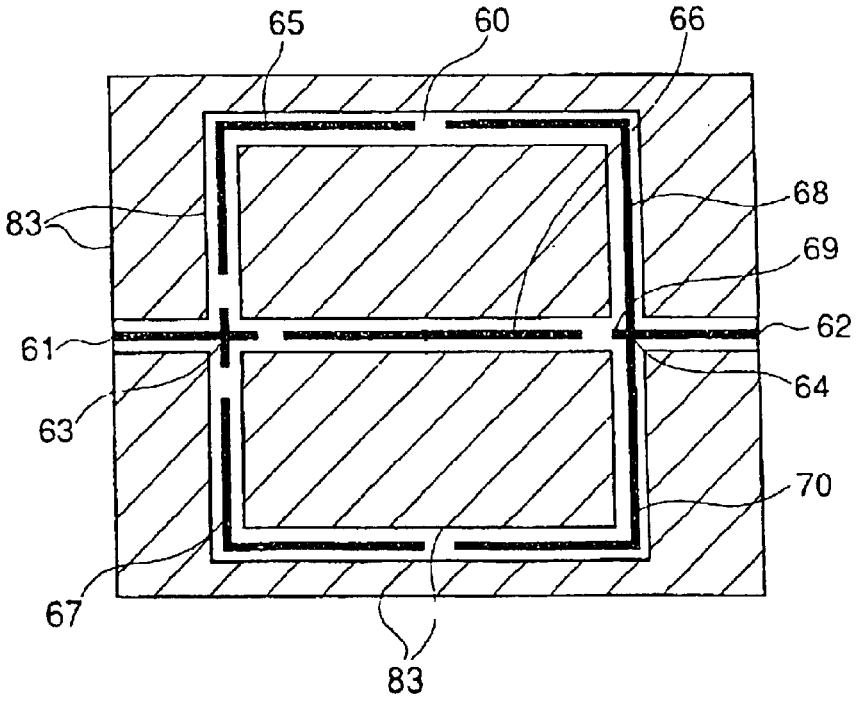
FIG. 13 is another modification example of the filter circuit shown in FIG. 10.

FIG. 13 is a modification example of FIG. 10 as the filter circuit of a coplanar line. As for the same reference numbers in FIG. 10, the explanation in FIG. 13 is omitted by referring to the above-mentioned explanation of FIG. 10. An aspect different from FIG. 10 is the ground metal 83 on the main face (the side on which the conductor 65 is formed) of the dielectric substrate 60.

Figure 14:
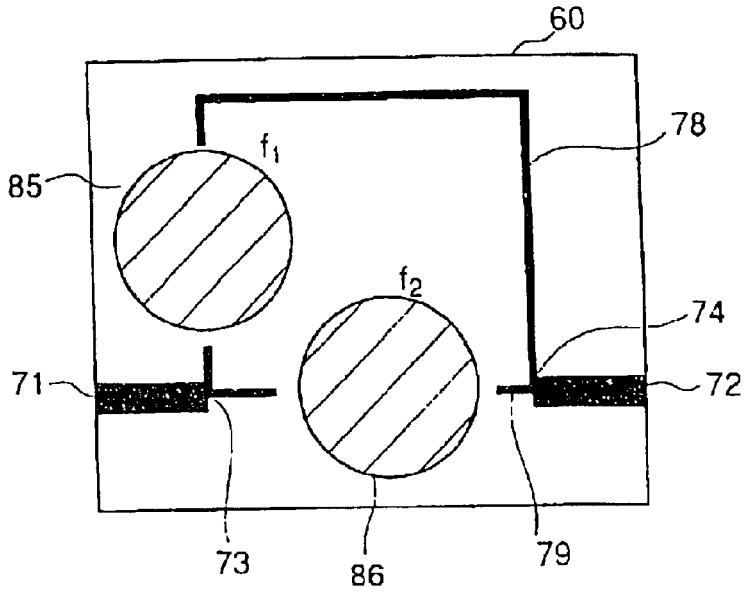
FIG. 14 is a modification example of the filter circuit shown in FIG. 11.

FIG. 14 is a modification example of FIG. 11 as the filter circuit of a planar line. As for the same reference numbers in FIG. 11, the explanation in FIG. 14 is omitted by referring to the above-mentioned explanation of FIG. 11. In FIG. 14, circular conductors 85, 86 replace the line conductors 75, 76 in FIG. 11.

Figure 15:
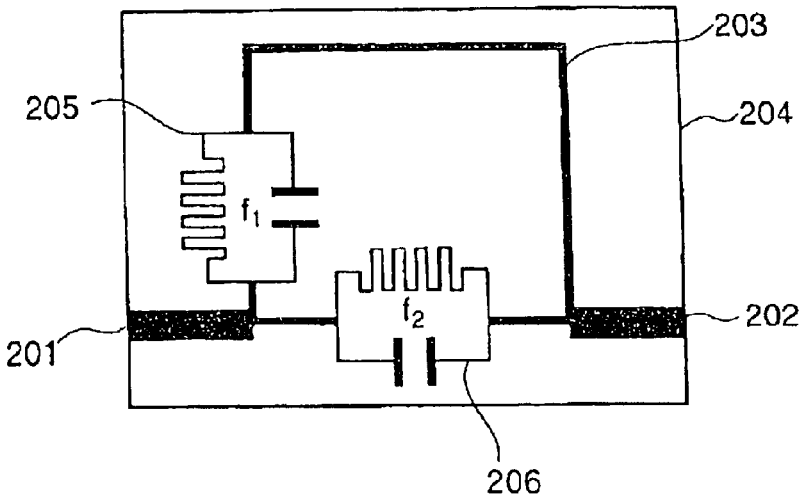
FIG. 15 is another modification example of the filter circuit shown in FIG. 11.

FIG. 15 shows an example of the filter circuit shown in FIG. 11 composed by a lumped element circuit. In FIG. 15, on semiconductor substrate 204 (For example, a GaAs substrate), the resonator 205 (resonance frequency f1) and the resonator 206 (resonance frequency f2) each consist of a capacitor and an inductor, and the delay unit 203 consists of Au wiring. A block including the resonator 205 and the delay unit 203 cascaded and the resonator 206 are connected in parallel between the input terminal 201 and the output terminal 202.

In this way, if the resonator is realized by different shape resonators or by connecting the distributed element circuit in parallel and the lumped element circuit, the first embodiment can be applied.

Figure 16:
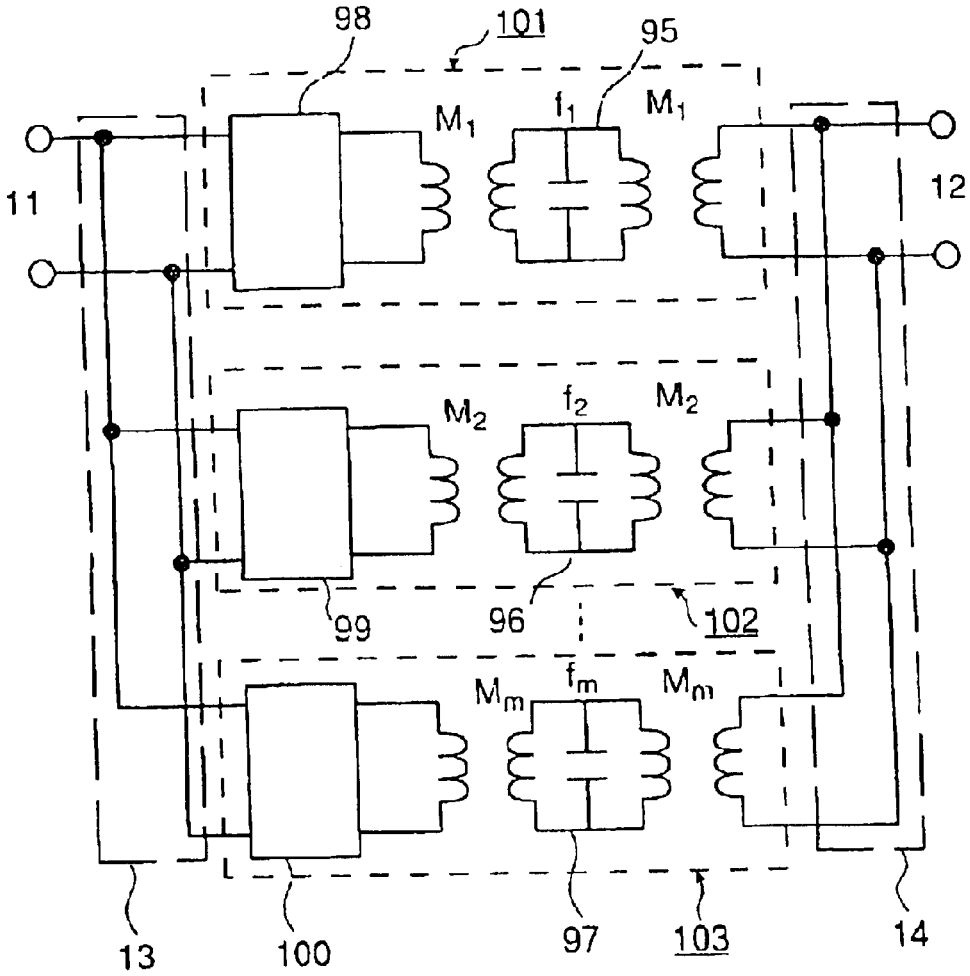
FIG. 16 is a block diagram of the first modification of the filter circuit shown in FIG. 4.

FIG. 16 is a block diagram of the filter circuit in FIG. 4 according to a modification of the first embodiment. In FIG. 4, the delay unit is located at the output side, but may be located at the input side. In FIG. 16, the delay unit in FIG. 4 is located at the input side, and the filter circuit is composed in the same way as in FIG. 4 by satisfying the above-mentioned condition of phase difference. The electric power division means 13 and the electric power combination means 14 are located between the input terminal 11 and the output terminal 12. The first block 101 in FIG. 4 corresponds to a block in which the delay unit 98 and the resonator 95 are cascaded. The second block 102 in FIG. 4 corresponds to a block in which the delay unit 99 and the resonator 96 are cascaded, and the third block 103 in FIG. 4 corresponds to a block in which the delay unit 100 and the resonator 97 are cascaded.

Figure 17:
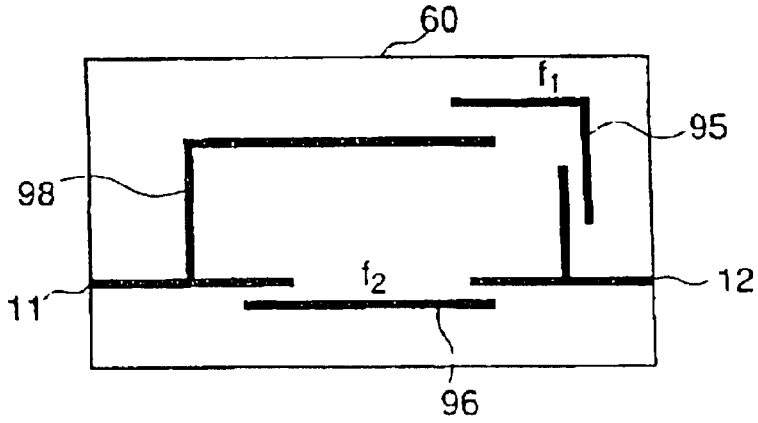
FIG. 17 is an example of the filter circuit shown in FIG. 16 using microstrip lines.

FIG. 17 shows an example of the filter circuit of a side-couple type using the microstrip line in FIG. 16. In FIG. 17, two blocks each of which the delay unit and the resonator are cascaded are shown. The electric power is divided into two by the input terminal 11. On electric power is immediately connected to the resonator 96 (resonance frequency f2) using electromagnetic field coupling, and the other electric power is connected to the resonator 95 (resonance frequency f1) through the delay unit 98 of delay value 180°. These outputs are combined as the electric power, and supplied to the output terminal 12.

Figure 18:
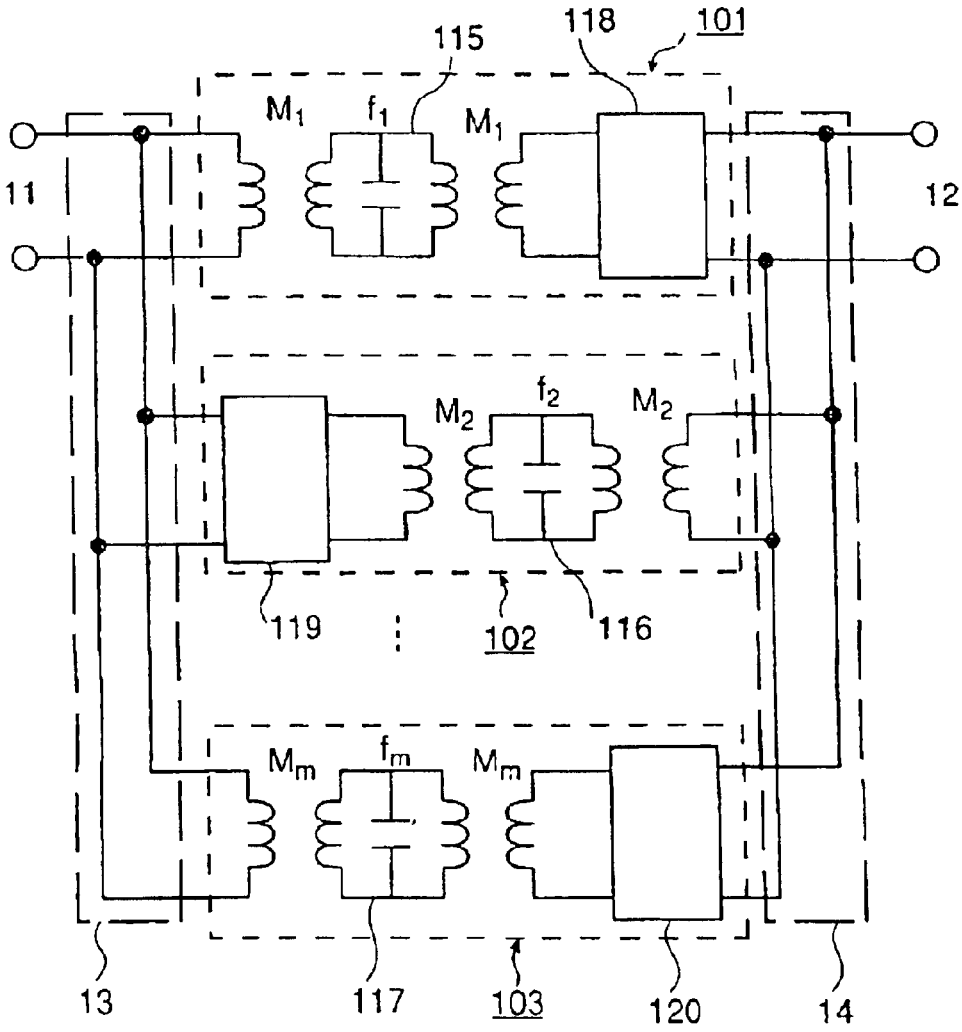
FIG. 18 is a block diagram of a second modification of the filter circuit shown in FIG. 4.

FIG. 18 is a block diagram of the filter circuit in FIG. 4 according to the second modification of the first embodiment. In FIG. 18, the delay units 118, 119, 120 are mixedly located at the input side and the output side. Each element 115~120 is respectively the same as each element 95~100 in FIG. 16.

Figure 19:
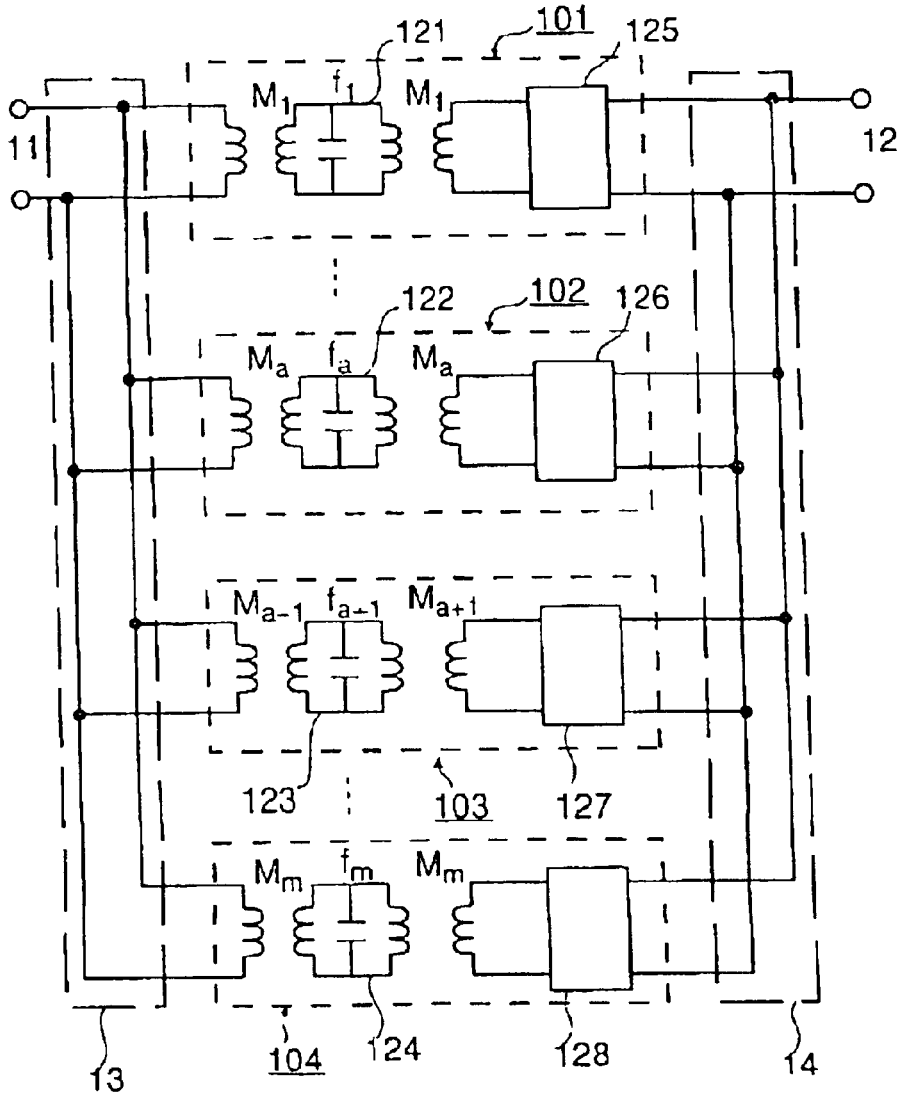
FIG. 19 is a block diagram of a third modification of the filter circuit shown in FIG. 4.
Figure 20:
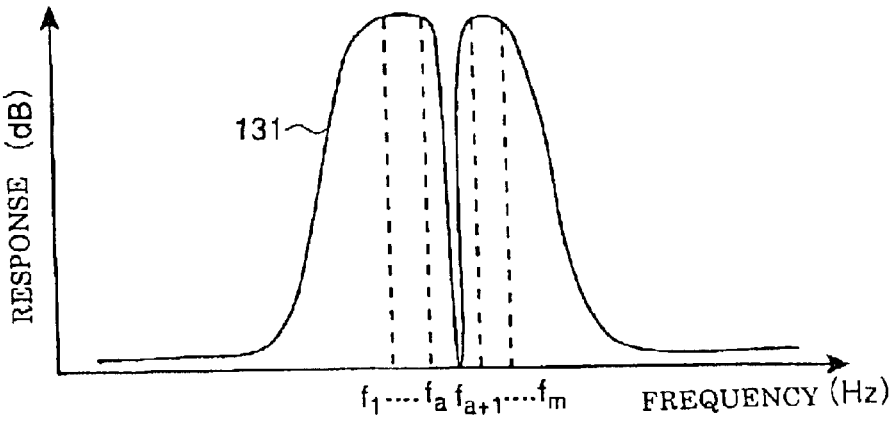
FIG. 20 is a waveform diagram of frequency response of the filter circuit shown in FIG. 19.

FIG. 19 is a block diagram of the filter circuit in FIG. 4 according to a third modification of the first embodiment. In FIG. 19, the a-th delay unit 126 and the (a+1)-th delay unit 127 are related as the phase difference of "360°×j±30° (j≧0: integer)". In short, a phase difference between two resonance frequencies of the a-th block 102 and the (a+1)-th block 103 are equal-phase, and a phase difference between two adjacent resonance frequencies (every two closest resonance frequencies on frequency axis) of two blocks except for a pair of the a-th block and th (a+1)-th block is reverse-phase. In this case, as shown in frequency response 131 of FIG. 20, a non-passing or filtered band fa~fa+1 can be realized in the designable frequency band f1~fm. Furthermore, if a plurality of non-passing bands are realized, then a plurality of the pairs each satisfies the above-mentioned condition.

Figure 21:
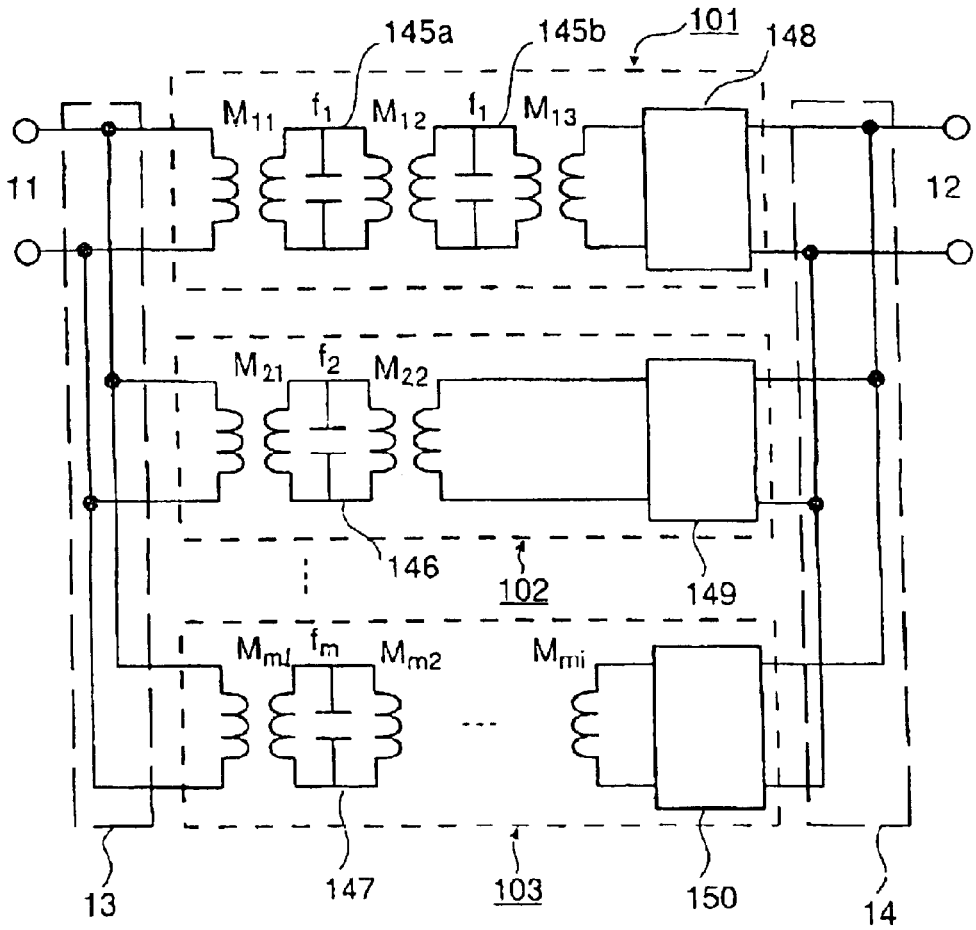
FIG. 21 is a block diagram of a fourth modification of the filter circuit shown in FIG. 4.

FIG. 21 is a block diagram of the filter circuit in FIG. 4 according to a fourth modification of the first embodiment of the present invention. In FIG. 21, a block in which the delay unit 148 is further cascaded to cascaded resonators 145*a* and 145*b* corresponds to the first block 101 in FIG. 4. If electric power distribution of each resonance frequency is previously known, the number of resonators to cascade to the delay unit is changed by value of pass-electric distribution. By composing the filter circuit as shown in FIG. 21, concentration of electric power in the resonators connected in parallel can be averaged by a small number of delay units.

Figure 22:
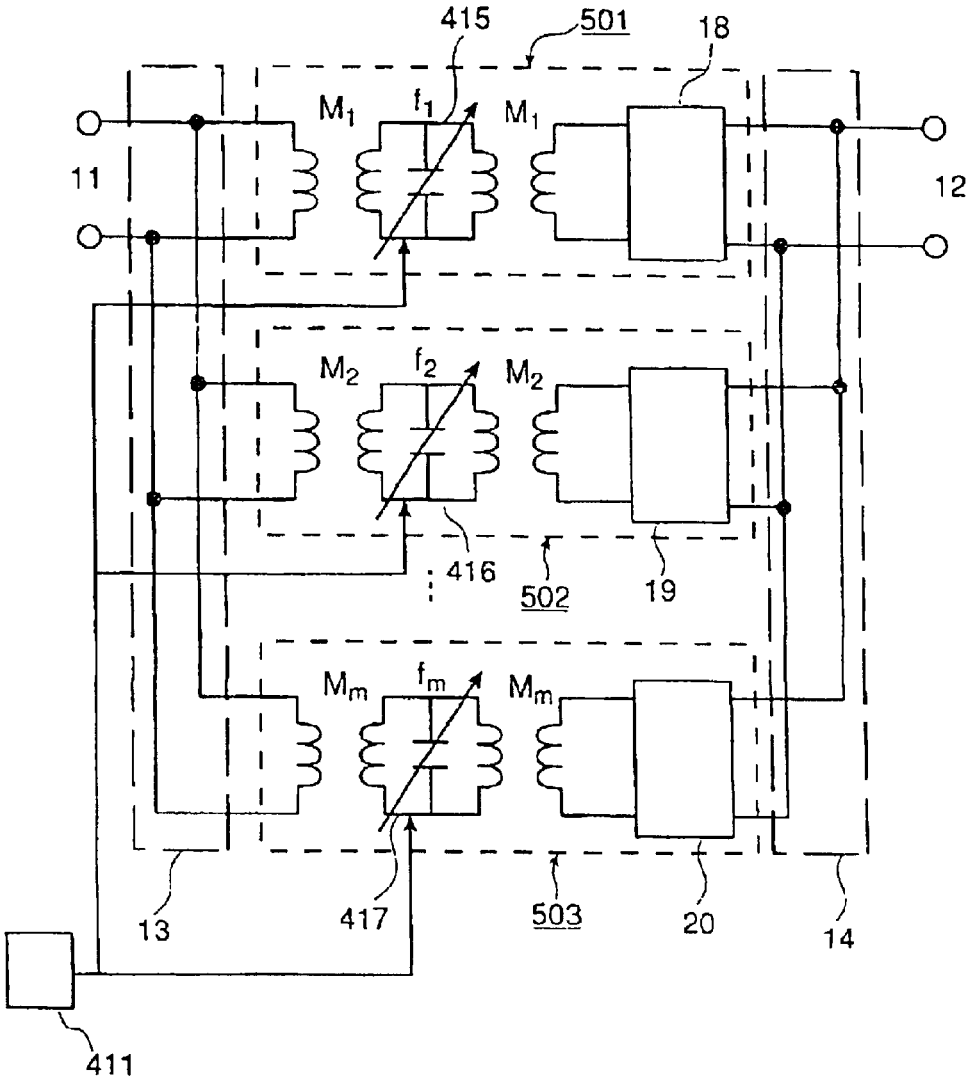
FIG. 22 is a block diagram of the filter circuit according to a second embodiment of the present invention.

FIG. 22 is a block diagram of the filter circuit according to a second embodiment of the present invention. As for the same reference numbers in FIG. 4, the explanation in FIG. 22 is omitted by referring to the above explanation of FIG. 4. As the aspects different from FIG. 4, the resonators 415, 416, 417 respectively include a variable frequency function, and each resonance frequency is independently varied by a control signal from a control apparatus 411. In order to explain in the same way as with FIG. 4, the resonator 415 and the cascaded delay unit 18 are called the first block 501, the resonator 416 and the cascaded delay unit 19 are called the second block 502, and the resonator 417 and the cascaded delay unit 20 are called the third block 503.

Figure 23:
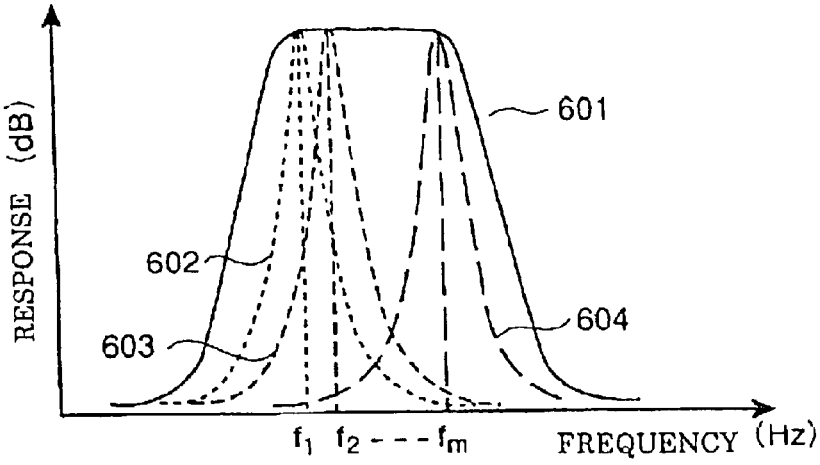
FIG. 23 is a waveform diagram of frequency response of the first setting in the filter circuit shown in FIG. 22.

FIG. 23 shows a frequency response characteristic in case of the first setting in the filter circuit of FIG. 22. As the first setting, the resonance frequency of each resonator is respectively set to a different value (f1, f2, . . . fm), and a phase difference between two adjacent resonance frequencies (f1 and f2, f2 and f3, . . . , fm−1 and fm) of two blocks is represented by the equation (2). In FIG. 23, a waveform 601 represents the frequency response from the input terminal 11 to the output terminal 12. As shown in each waveform 602, 603, and 604 resonance peaks of each different value are arranged on a frequency axis, and maximum pass-band as the filter circuit can be set.

Figure 24:
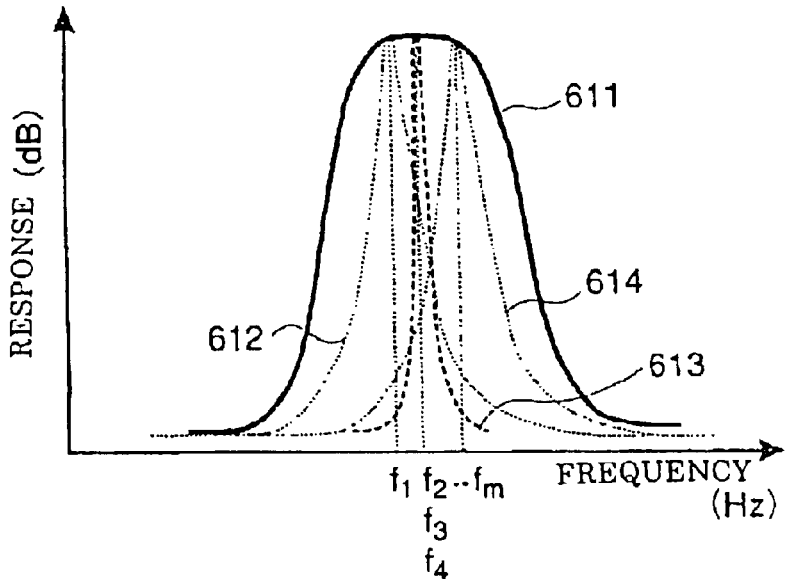
FIG. 24 is a waveform diagram of frequency response of the second setting in the filter circuit shown in FIG. 22.

FIG. 24 shows a frequency response characteristic in case of the second setting in the filter circuit of FIG. 22. As the second setting, the pass-band of the filter circuit is controlled toward a narrower direction on the frequency axis. For example, a phase difference between adjacent resonance frequencies (f2, f3) of two resonators is set as nearly equal-phase "(360°×n)±30°" by the delay unit of the two resonators, and three resonance frequencies (f2, f3, f4) of three resonators are controlled below 10% of pass-band of resonator level by the control signal. In this case, waveforms of the two adjacent resonance frequencies (f2, f3) of equal-phase cancel each other, and the resonance frequency (f4) is further overlapped. As a result, waveforms of the resonance frequencies (f2, f3, f4) form one waveform 613. As for other resonance frequencies except for the resonance frequency (f2, f3, f4), in the same way as the first setting, a phase difference between every two adjacent resonance frequencies of two blocks is represented by the equation (2) as shown in waveforms 612, 614. The waveform 611 represents the frequency response from the input terminal 11 to the output terminal 12. Thus, the control apparatus 411 in FIG. 22 controls three resonance frequencies (f2, f3, f4) to overlap as shown in the waveform 613 of FIG. 24. As a result, the pass-band of the filter circuit is transformed toward narrower direction on the frequency axis.

Figure 25:
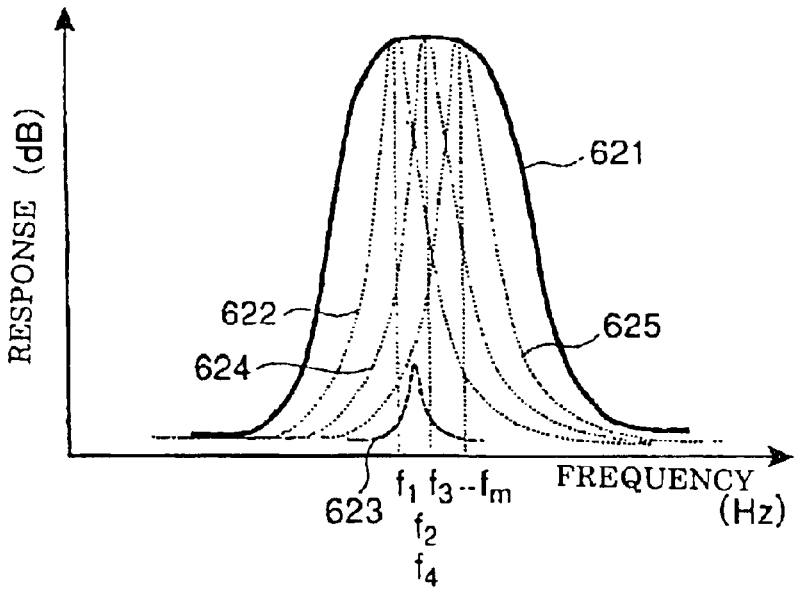
FIG. 25 is a waveform diagram of frequency response of the third setting in the filter circuit shown in FIG. 22.

FIG. 25 shows frequency response characteristic in case of the third setting in the filter circuit of FIG. 22. As the third setting, in the same way as the second setting, the pass-band of the filter circuit is controlled toward a narrower direction on the frequency axis. For example, a phase difference between two separated resonance frequencies (f2, f4) of two resonators is set as nearly equal-phase by the delay unit of the two resonators, and the two resonance frequencies (f2, f4) of the two resonators are controlled below 10% of pass-band of resonator level by the control signal. In this case, waveforms of the two resonance frequencies (f2, f4) cancel each other, and the effect of the resonance waveform of the resonance frequencies (f2, f4) can be reduced as shown in waveform 623. As for other resonance frequencies except for the resonance frequency (f2, f4), in the same way as in the first setting, a phase difference between every two adjacent resonance frequencies of two blocks is represented by the equation (2) as shown in waveforms 622, 624, 625. The waveform 621 represents the frequency response from the input terminal 11 to the output terminal 12. Thus, the number of resonance frequencies that contributed to the frequency response is reduced and the pass-band of the filter circuit is transformed toward the narrower direction on the frequency axis.

Figure 1:
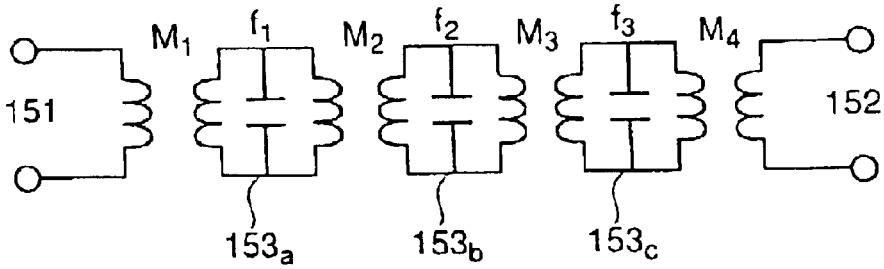
FIG. 1 ( PRIOR ART )
FIG. 1 is a block diagram of a resonator.
Figure 2:
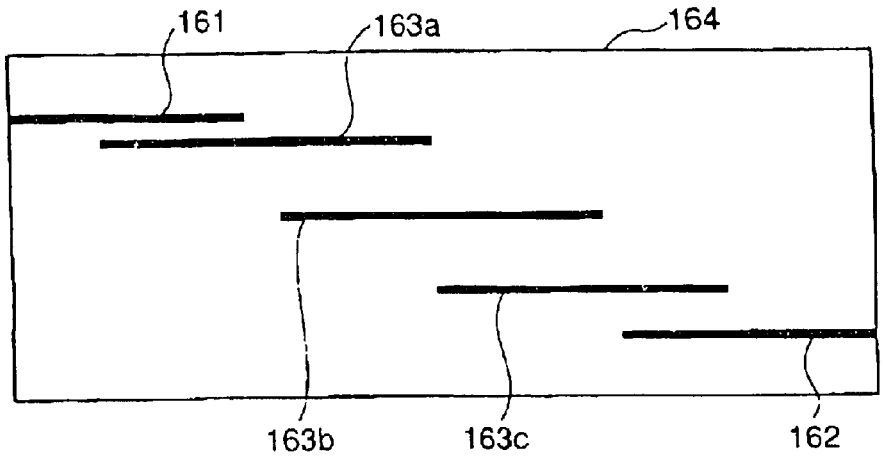
FIG. 2 ( PRIOR ART )
FIG. 2 is an example of the circuit shown in FIG. 1 using microstrip lines.
Figure 3:
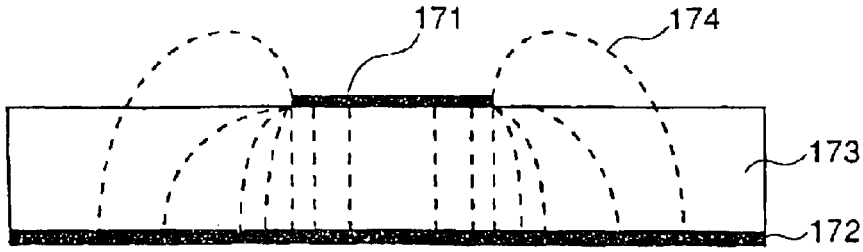
FIG. 3 ( PRIOR ART )
FIG. 3 is a schematic diagram of electric force lines in the component shown in FIG. 2.

As shown in FIG. 1, in order to vary the center frequency and the pass band in the filter circuit in which n units of resonators are cascaded, control of (2n+1) units of the resonance frequency (n units), the external Q (2 units), and the coupling factor ((n−1) units) for each resonator is necessary. However, in the second embodiment, the pass-band is varied by controlling the resonance frequency of each resonator, i.e., by n units of control. Furthermore, in the past, (2n+1) units of control signal lines from the control apparatus are necessary. However, in the second embodiment, only n units of control signal lines are only necessary.

As an application example of the second embodiment, a filter circuit using a superconducting conductor is utilized as a base station. This filter circuit must be packaged in a refrigerator because the superconducting conductor is used. In comparison with the prior art, heat-penetration from the control signal lines to the refrigerator is reduced and it is possible that the base station is driven in a small-sized refrigerator. Furthermore, in the same way as in the first embodiment, any resonator of the distributed element circuit and the lumped element circuit such as a half-wave length resonator of microstrip line type can consist of the filter circuit.

Figure 26:
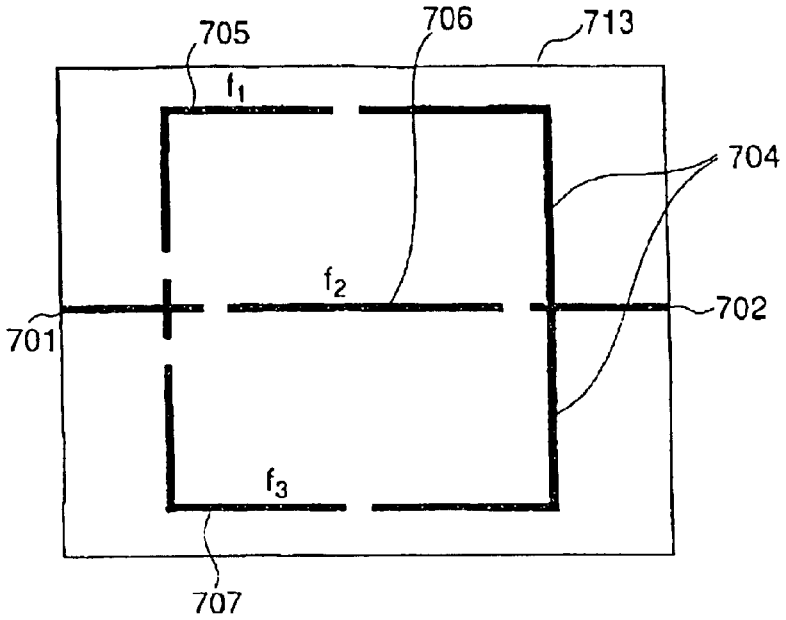
FIG. 26 is an example of the filter circuit shown in FIG. 22 by the microstrip line.
Figure 27:
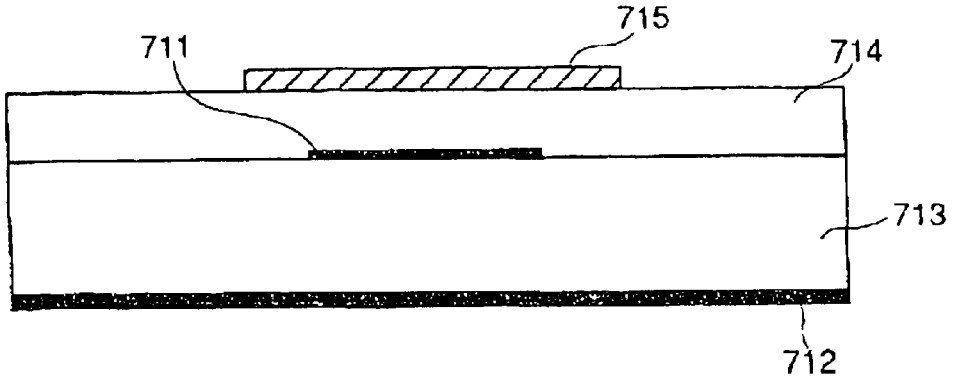
FIG. 27 is a sectional plane of the example of the circuit shown in FIG. 26.

FIGS. 26 and 27 show an example of a half-wave length resonator of the microstrip line type. FIG. 26 is a plan view corresponding to FIG. 10 (a dielectric film 714 and a voltage impressed element 715 are omitted). FIG. 27 is a sectional plan view neighboring the resonator 711. The resonator 711 in FIG. 27 corresponds to conductors 705, 706, 707 in FIG. 26.

One surface of the conductors formed on both surfaces of the dielectric is patterned as the resonator 711. The relative permittivity of dielectric film 714 is varied by an impressed voltage and is laid over the resonator 711. The voltage impressed element 715 (material is $SrRuO_3$) is located on the dielectric film 714. As representative material for the dielectric substrate 713, MgO, $SrTiO_3$, $LaAlO_3$, are selectively utilized. Furthermore, by utilizing a superconducting conductor as the conductor 711 and the ground metal 712, the filter circuit of characteristic of great low lose can be realized. As representative material of the superconducting conductor, an oxide such as yttrium, bismuth, thallium, and NbSn are well known. As the patterning method, MOCVD method, sputtering method, laser ablation method, liquid deposition method are selectively used. Furthermore, as material of the dielectric film 714 of which relative permittivity is varied by impressed voltage, a ferroelectric substance such as $SrTiO_3$, $Ba_xSr_{1-x}TiO_3$, is well known. When the voltage is impressed to the voltage impressed element 715 by the control signal from the control apparatus 411 in FIG. 22, the relative permittivity of the dielectric film 714 on the resonator 711 varies, and the resonance frequency varies by varying the propagation constant of the resonator 711. As one method for patterning this filter circuit, the conductor is attached on both surfaces of the dielectric substrate by a laser ablation method, and the one surface is patterned as the layout shown in FIG. 26. Then, the dielectric film 714 is attached on the one surface by the laser ablation method. Last, the voltage impressed element 714 is pattern d as electrode by the sputtering method. In this way, the filter circuit is manufactured.

In the above-mentioned explanation, the voltage impressed element 715 is located on the conductors 705, 706, 707 for the resonator. However, the second embodiment is not limited to this patterning. The voltage impressed element 715 may be located on other conductors (the input terminal 701, the output terminal 702, the delay unit 704) patterned on the dielectric substrate 713. In this case, by varying the relative permittivity of the ferroelectric substance 714 between the conductor of resonator and the other conductor, the mutual coupling degree can be varied. Furthermore, the first embodiment and the second embodiment may be executed by suitably combining.

As mentioned-above, in the present invention, the filter circuit and the superconducting filter circuit, which are small in size and have a superior characteristic of maximum available power can be provided.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A filter circuit, comprising:

a first resonator, a second resonator and a third resonator each having a resonance frequency differently arranged in order on a frequency axis, a first block including the first resonator, a second block including the second resonator, a third block including the third resonator, wherein the first block includes a delay unit connected to the first resonator, and the third block includes another delay unit connected to the third resonator;

an input terminal configured to divide an input signal to the first block, the second block and the third block; and an output terminal configured to combine signals passing through the first block, the second block and the third block, and to output the combined signal;

wherein the delay unit converts a phase of the signal passing through the first block to reverse phase or nearly reverse-phase, and wherein another delay unit converts a phase of the signal passing through the third block to reverse-phase or nearly reverse-phase.

2. The filter circuit according to claim 1, wherein the second block does not include a delay unit connected to the second resonator.

3. The filter circuit according to claim 1, wherein the delay unit is located in the input terminal side of the first resonator, and wherein another delay unit is located in the input terminal side of the third resonator.

4. The filter circuit according to claim 1, wherein the delay unit is located in the output terminal side of the first resonator, and wherein another delay unit is located in the output terminal side of the third resonator.

5. The filter circuit according to claim 1, wherein the delay unit is located in the input terminal side of the first resonator, and wherein another delay unit is located in the output terminal side of the third resonator.

6. The filter circuit according to claim 1, wherein the delay unit is located in the output terminal side of the first resonator, and wherein another delay unit is located in the input terminal side of the third resonator.

7. The filter circuit according to claim 1, further comprising at least one block including one resonator, each resonance frequency of the first block, the second block, the third block and the at least one block is differently arranged in order on the frequency axis, odd-numbered blocks in all blocks respectively includes a delay unit, wherein the delay unit converts a phase of the signal passing through the odd-numbered block to reverse-phase or nearly reverse-phase.

8. The filter circuit according to claim 7, wherein a phase difference X between the input signal and the signal passed from the odd-numbered block is represented as $$150°+360°\times n \leqq x \leqq 210°+360°\times n \ (n \geqq 0\text{: integer}).$$

9. The filter circuit according to claim 7, wherein two blocks have two adjacent resonance frequencies on the frequency axis, and wherein the delay unit of the odd-numbered block of the particular two blocks does not convert a phase of the signal passing through the odd numbered block to reverse-phase or nearly reverse-phase.

10. The filter circuit according to claim 7, wherein at least one block includes a plurality of resonators cascaded, in accordance with a distribution of pass-electric power of the one block in the all blocks.

11. The filter circuit according to claim 1, wherein the first resonator, the second resonator, the third resonator, the delay unit, another delay unit, the input terminal and the output terminal comprise microstrip lines.

12. The filter circuit according to claim 11, wherein the microstrip lines are formed on a main face of a dielectric substrate on a ground metal.

13. The filter circuit according to claim 11, wherein the microstrip line of each resonator is formed as a half-wave length of the resonance frequency of the resonator.

14. The filter circuit according to claim 13, wherein the microstrip line of each delay unit is formed as a length based on the length of the resonator connected to the delay unit.

15. The filter circuit according to claim 11, wherein the microstrip line of each terminal includes a width wider than a width of the microstrip lines of each resonator and each delay unit.

16. The filter circuit according to claim 11, wherein at least one of the delay units is a meandering line.

17. The filter circuit according to claim 11, wherein the microstrip lines are formed on the ground metal as a coplanar line.

18. The filter circuit according to claim 1, wherein the first resonator, the second resonator and the third resonator comprise circular conductors as a planar line.

19. The filter circuit according to claim 1, wherein the first resonator, the second resonator and the third resonator comprise lumped element circuits.

20. A superconducting filter circuit, comprising:

a first resonator, a second resonator and a third resonator each having a resonance frequency differently arranged in order on a frequency axis, a first block including the first resonator having a superconductive material, a second block including the second resonator having a superconductive material, a third block including the third resonator having a superconductive material, wherein the first block includes a delay unit connected to the first resonator, and the third block includes another delay unit connected to the third resonator, an input terminal configured to divide an input signal to the first block, the second block and the third block; and an output terminal configured to combine signals passing through the first block, the second block and the third block, and to output the combined signal;

wherein the delay unit converts a phase of the signal passing through the first block to reverse-phase or nearly reverse-phase, and wherein another delay unit converts a phase of the signal passing through the third block to reverse-phase or nearly reverse-phase.

* * * * *